US009808913B2

(12) United States Patent
Lin

(10) Patent No.: US 9,808,913 B2
(45) Date of Patent: Nov. 7, 2017

(54) VISE

(71) Applicant: Hsi-Shui Lin, Taichung (TW)

(72) Inventor: Hsi-Shui Lin, Taichung (TW)

( * ) Notice: Subject to any disclaimer, the term of this patent is extended or adjusted under 35 U.S.C. 154(b) by 350 days.

(21) Appl. No.: 14/823,660

(22) Filed: Aug. 11, 2015

(65) Prior Publication Data

US 2015/0343606 A1 Dec. 3, 2015

(51) Int. Cl.
*B25B 1/24* (2006.01)
*B25B 1/10* (2006.01)
*B25B 1/18* (2006.01)

(52) U.S. Cl.
CPC ..... *B25B 1/2478* (2013.01); *B25B 1/103* (2013.01); *B25B 1/106* (2013.01); *B25B 1/18* (2013.01); *B25B 1/2405* (2013.01)

(58) Field of Classification Search
CPC . B23Q 1/28; B23Q 1/545; B23Q 1/50; B12Q 3/066; B12Q 3/061; B12Q 3/02; B12Q 3/08; B25B 1/02; B25B 1/18; B25B 1/04; B25B 1/06; B25B 1/08; B25B 1/103; B25B 1/106
See application file for complete search history.

(56) References Cited

U.S. PATENT DOCUMENTS 3,400,924 A * 9/1968 Wermuth ..... B25B 1/106 269/228
3,650,522 A * 3/1972 Wermuth ..... B25B 1/103 269/221
3,807,721 A * 4/1974 Arnold ..... B25B 1/106 269/228
4,591,199 A * 5/1986 Zajac ..... B25B 1/18 269/32
4,899,999 A * 2/1990 Arnold ..... B25B 1/106 269/221
5,351,943 A * 10/1994 Milz ..... B25B 1/106 269/153
8,256,753 B2 * 9/2012 Teo ..... B25B 1/103 269/240
8,690,138 B2 * 4/2014 Lin ..... B25B 1/106 269/240
8,939,442 B2 * 1/2015 Wang ..... B25B 1/103 269/153

* cited by examiner

*Primary Examiner* — Monica Carter
*Assistant Examiner* — Seahee Yoon

(57) ABSTRACT

A vise includes a groove-shaped vise body; an internally threaded first sliding member in the vise body; an internally threaded second sliding member in the vise body; a fixed jaw secured to the vise body; a first movable jaw on the first sliding member, a second movable jaw on the second sliding member, a rotatable shaft at an end of the vise body, an actuation assembly in the vise body and including a hollow first threaded shaft passing through and secured to the first sliding member, and secured to the fastening device, a hollow second threaded shaft passing through the second sliding member and secured to the second sliding member, a first movable rod in the first threaded shaft and secured to the rotatable shaft, a second movable rod in the second threaded shaft, and a pushing rod engaging the first movable rod, and a force transmitting assembly.

1 Claim, 9 Drawing Sheets

VISE

BACKGROUND OF THE INVENTION

1. Field of the Invention

The invention relates to vises and more particularly to a vise having improved characteristics such as increased work piece clamping force.

2. Description of Related Art

Vise is a mechanical apparatus used to secure an object to allow work to be performed on it. Vises have two parallel jaws in which one is fixed and the other is movable. The movable jaw is threaded in and out by a screw and a lever.

There is a conventional vise including a seat body having two movable jaws, a fixed jaw, and a rail. A screwing rod has a rear portion and a front portion having a diameter less than the rear portion. First outer threads are disposed on the rear portion. A step is formed between the front portion and the rear portion. A screwing tube telescopically puts on the front portion of the screwing rod and has outer threads. The two movable jaws are engaged with the screwing tube and screwing rod by screwing the outer threads and the inner threads respectively. A spiral direction of the first outer threads is contrary to the second outer threads. A spring member is biased between the screwing rod and screwing tube. A lever is connected to the front portion of the screwing rod for rotating the screwing rod.

While the device enjoys its success in the market, continuing improvements in the exploitation of vise of this type are constantly sought.

SUMMARY OF THE INVENTION

It is therefore one object of the invention to provide a vise comprising a groove-shaped vise body including two grooves on inner surfaces of two sides respectively; an internally threaded first sliding member including a concave surface, the first sliding members being configured to slide with respect to the vise body by sliding along the grooves; an internally threaded second sliding member including a concave surface, the second sliding members being configured to slide with respect to the vise body by sliding along the grooves; a fixed jaw secured to a top of an intermediate portion of the vise body; a first movable jaw put on the first sliding member, the first movable jaw including a rod member disposed between the concave surface of the first sliding member and an inner surface of the first movable jaw; a second movable jaw put on the second sliding member, the second movable jaw including a rod member disposed between the concave surface of the second sliding member and an inner surface of the second movable jaw; a fastening device secured to the vise body and adjacent to the first movable jaw, the fastening device including a rotatable shaft; an actuation assembly disposed in the vise body, the actuation assembly including a hollow first threaded shaft threadedly passing through the first sliding member and secured to the fastening device, a hollow second threaded shaft threadedly passing through the second sliding member, a first movable rod disposed in the first threaded shaft and secured to the rotatable shaft, a second movable rod disposed in the second threaded shaft, and a pushing rod engaging the first movable rod, the pushing rod having an inclined surface distal the first movable rod; and a force transmitting assembly disposed between the first threaded shaft and the second threaded shaft and under the fixed jaw, the force transmitting assembly including a hollow cylindrical housing secured to the first threaded shaft, a hollow activation member disposed in the housing and having two opposite troughs, a positioning member disposed in the housing and having two opposite troughs, two toggle joints each having a first end pivotaby disposed in one of the troughs of the positioning member, and a second end pivotably disposed in one of the troughs of the activation member, a spring-biased member disposed in the activation member and engaging the pushing rod, a biasing member put on the second movable rod and anchored between the second movable rod and the second threaded shaft, a ring member put on the activation member and biased between the biasing member and the activation member, and a resilient ring put on the pushing rod and biased between the activation member and the first threaded shaft; whereby upon clockwise rotating the rotatable shaft, the first threaded shaft is rotated causing the first sliding member to move the first movable jaw toward the fixed jaw, compress the resilient ring, push the first movable rod to move the pushing rod which in turn straightens the toggle joints, push the housing toward the second movable jaw by compressing the biasing member, push the second movable rod to rotate the second threaded shaft which in turn moves the second sliding member toward the housing, and move the second movable jaw toward the fixed jaw.

The above and other objects, features and advantages of the invention will become apparent from the following detailed description taken with the accompanying drawings.

DETAILED DESCRIPTION OF THE INVENTION

Figure 1:
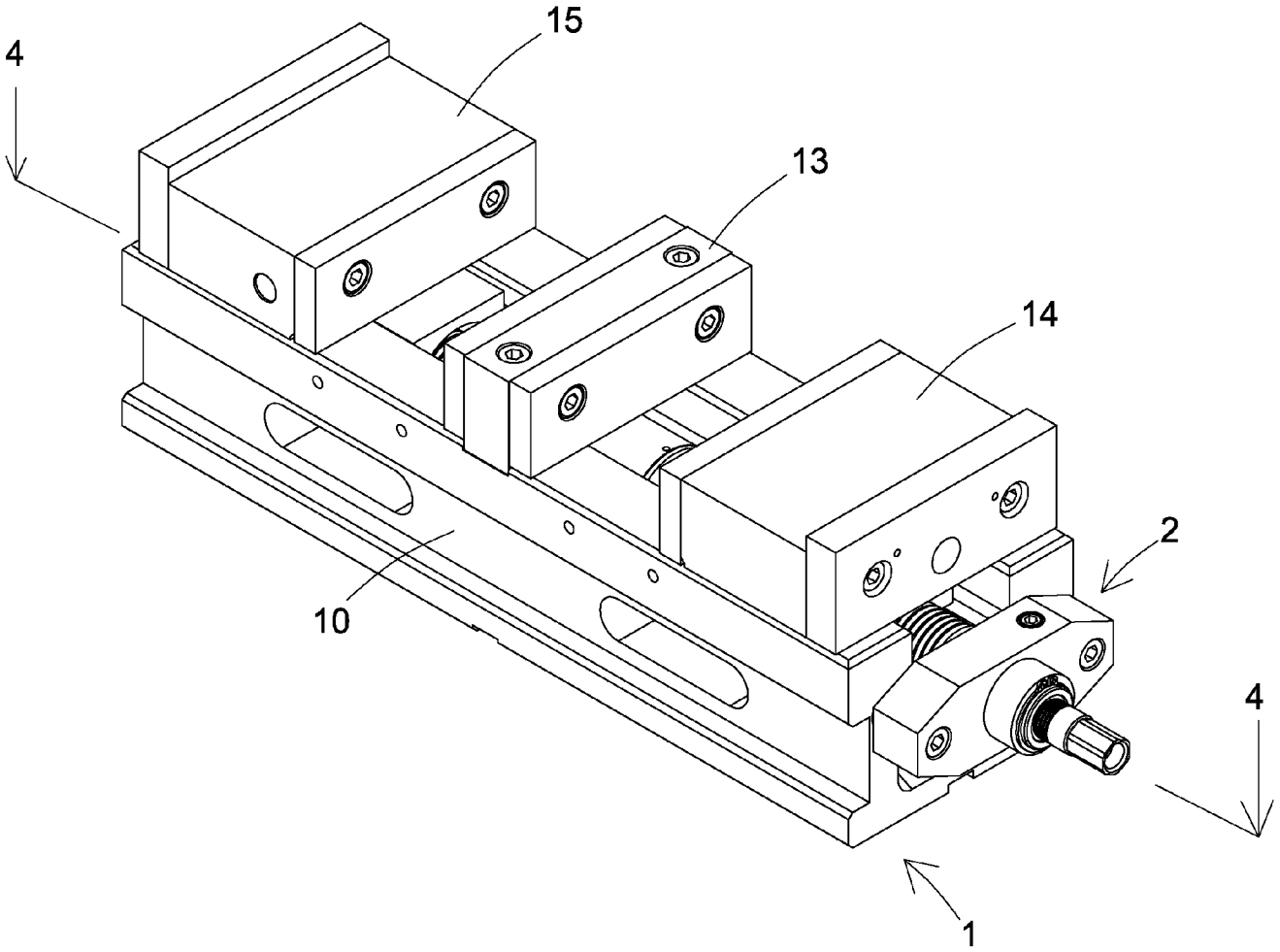
FIG. 1 is a perspective view of a vise according to the invention.
Figure 2:
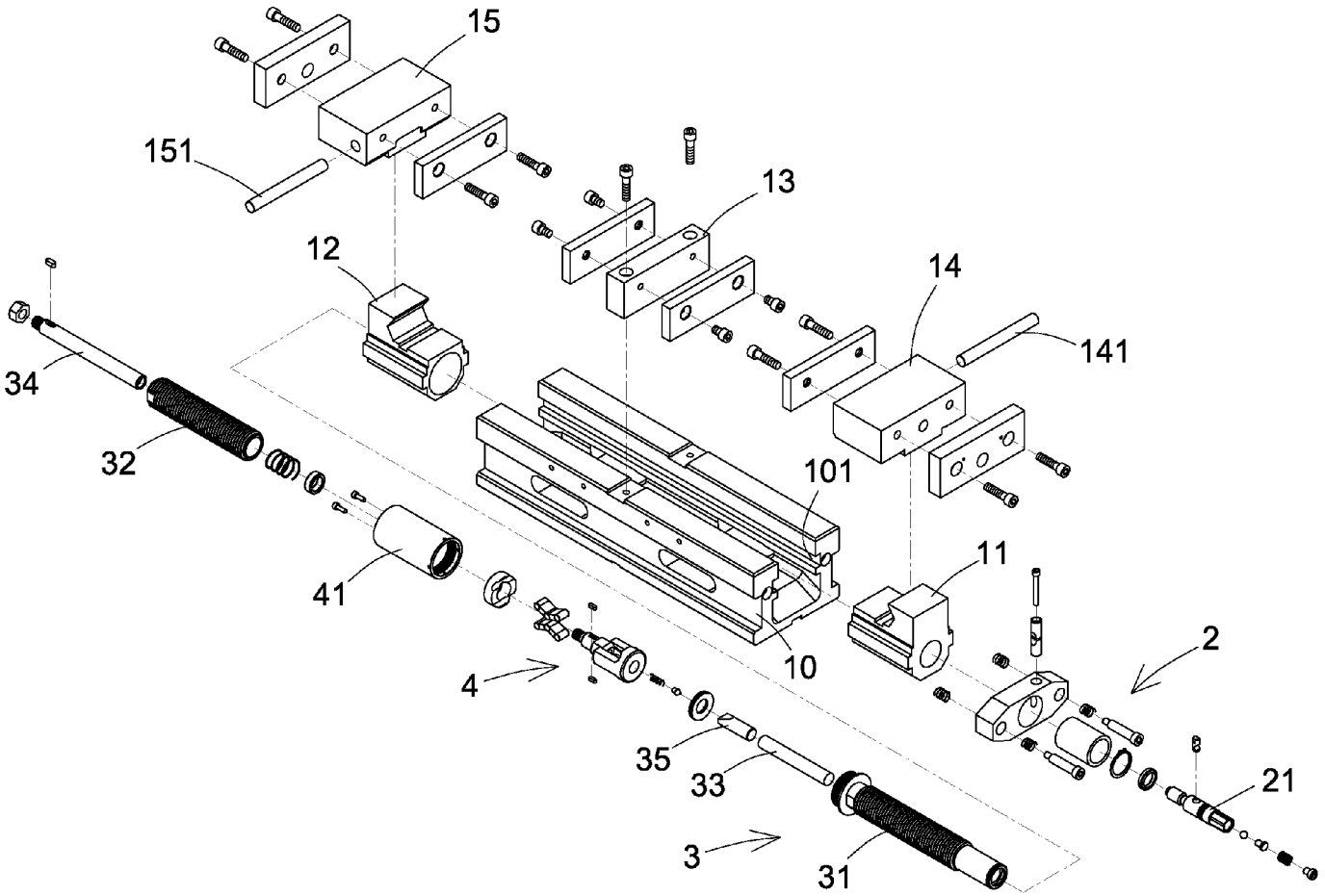
FIG. 2 is an exploded view of the vise.
Figure 3:
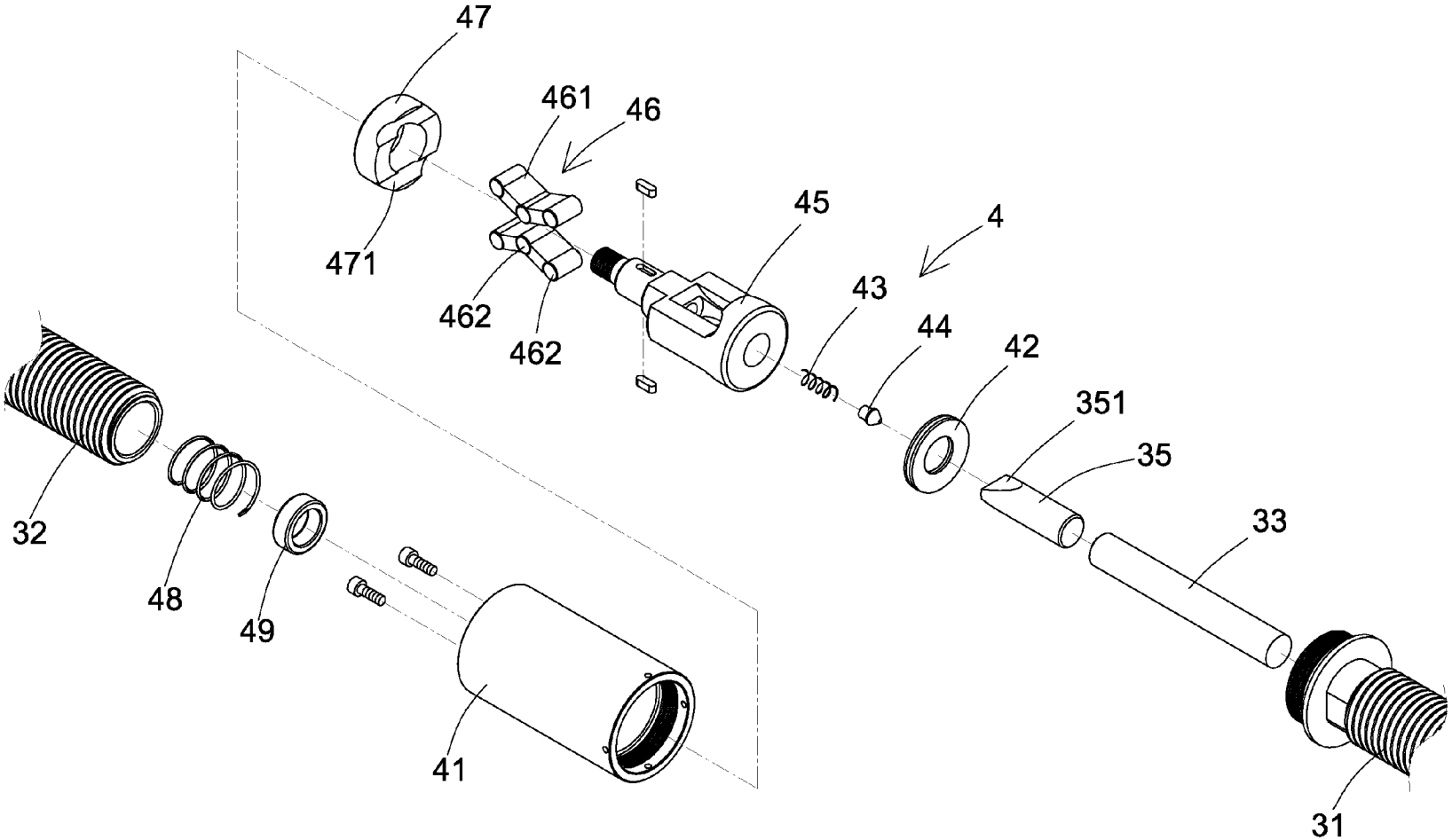
FIG. 3 is an exploded view of the force transmitting assembly of a first embodiment.
Figure 4:
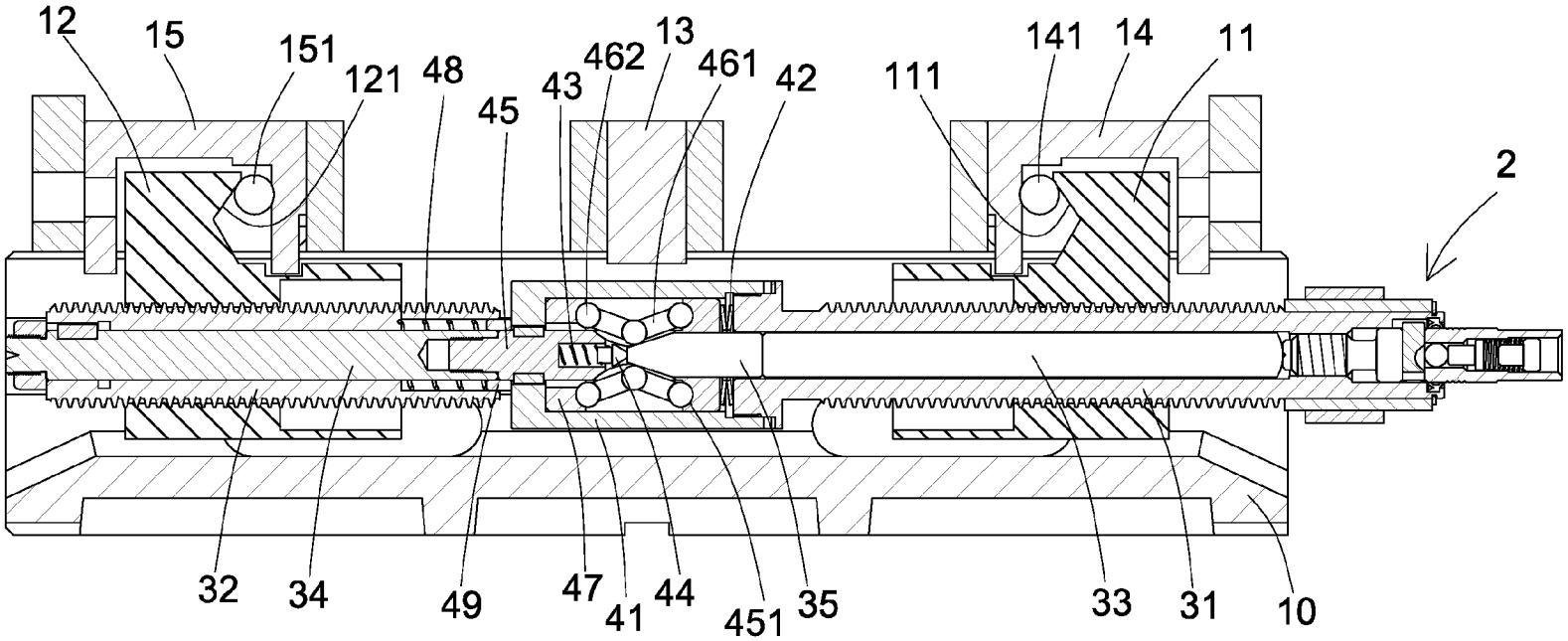
FIG. 4 is a sectional view taken along line 4-4 of FIG. 1.
Figure 5:
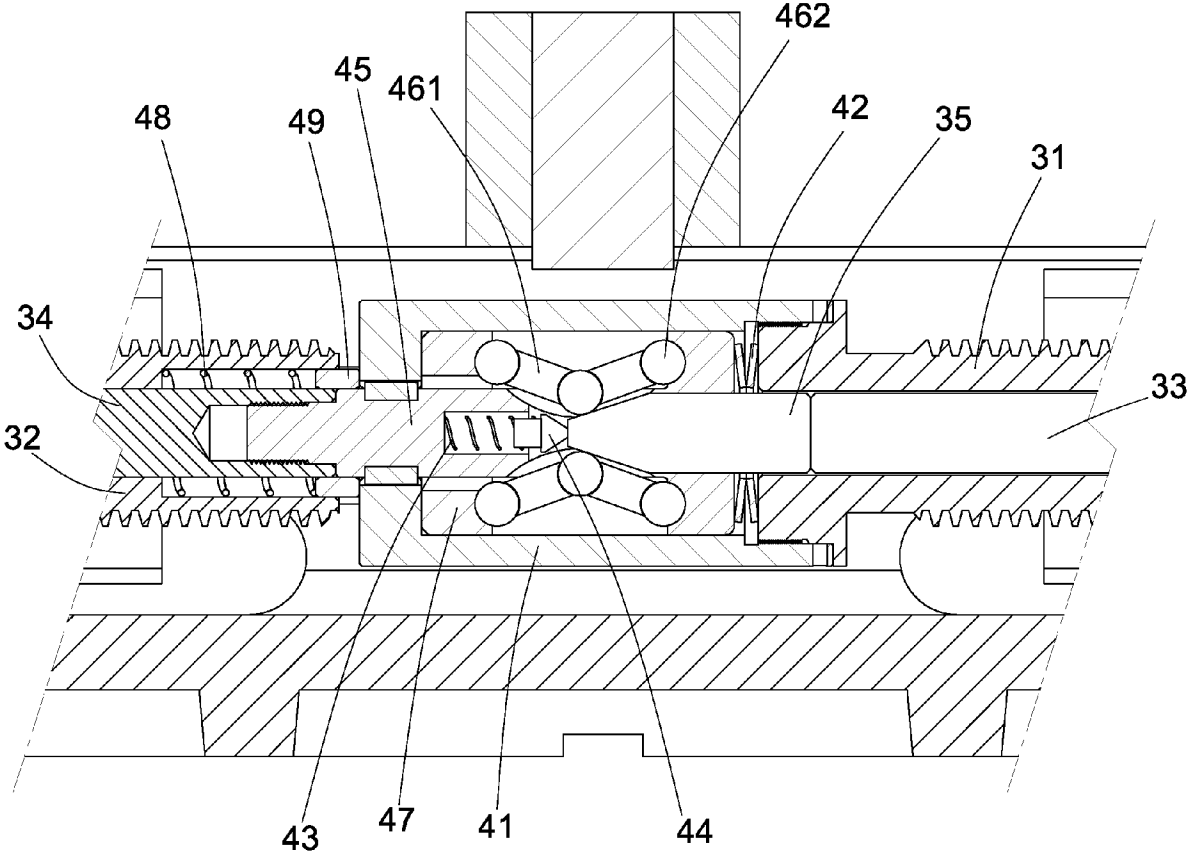
FIG. 5 is an enlarged view of the intermediate portion of FIG. 4.

Referring to FIGS. 1 to 7, a vise 1 in accordance with the invention comprises the following components as discussed in detail below.

A vise body 10 has a U-shaped longitudinal section and includes two grooves 101 on inner surfaces of two sides respectively. An internally threaded first sliding member 11 has a concave surface 111 and an internally threaded second sliding member 12 has a concave surface 121. The opposite first and second sliding members 11, 12 can slide with respect to the vise body 10 by sliding along the grooves 101. A fixed jaw 13 is threadedly secured to a top of an intermediate portion of the vise body 10. A first movable jaw 14 is put on the first sliding member 11 and includes a rod member 141 fastened by the concave surface 111 and an inner surface of the first movable jaw 14. A second movable jaw 15 is put on the second sliding member 12 and includes a rod member 151 fastened by the concave surface 121 and an inner surface of the second movable jaw 15.

A fastening device 2 is secured to a first end of the vise body 10 and adjacent to the first movable jaw 14. The fastening device 2 includes a rotatable shaft 21. An actuation assembly 3 is disposed in the vise body 10 and includes a hollow first threaded shaft 31 threadedly passing through the first sliding member 11, the first threaded shaft 31 having a bare portion secured to the fastening device 2, a hollow second threaded shaft 32 threadedly passing through the second sliding member 12, a first movable rod 33 in the first threaded shaft 31 and having a first end secured to the rotatable shaft 21, a second movable rod 34 in the second threaded shaft 32, and a pushing rod 35 engaging an end of the first movable rod 33, the pushing rod 35 having an inclined surface 351 distal the first movable rod 33.

A force transmitting assembly 4 of a first embodiment is provided between the first threaded shaft 31 and the second threaded shaft 32. The force transmitting assembly 4 is disposed under the fixed jaw 13. The force transmitting assembly 4 includes a hollow cylindrical housing 41 threadedly secured to the first threaded shaft 31, a hollow activation member 45 in the housing 41 and having two opposite troughs 451, a positioning member 47 engaging an inner end of the housing 41 and having two opposite troughs 471, a toggle joint mechanism 46 having two toggle joints 461 each having three rod elements 462 at a first end, a second end, and a central portion respectively, the rod element 462 at the first end of the toggle joint 461 being positioned in the trough 471 and the rod element 462 at the second end of the toggle joint 461 being positioned in the trough 451, a torsion spring 43 anchored in the activation member 45, a pointed member 44 biased between the spring 43 and the pushing rod 35, a helical spring 48 put on the second movable rod 34 and anchored in a space between the second movable rod 34 and the second threaded shaft 32, a ring member 49 put on one end of the activation member 45 and biased between the spring 48 and the activation member 45, and a resilient ring 42 put on the pushing rod 35 and biased between the other end of the activation member 45 and the first threaded shaft 31.

Figure 6:
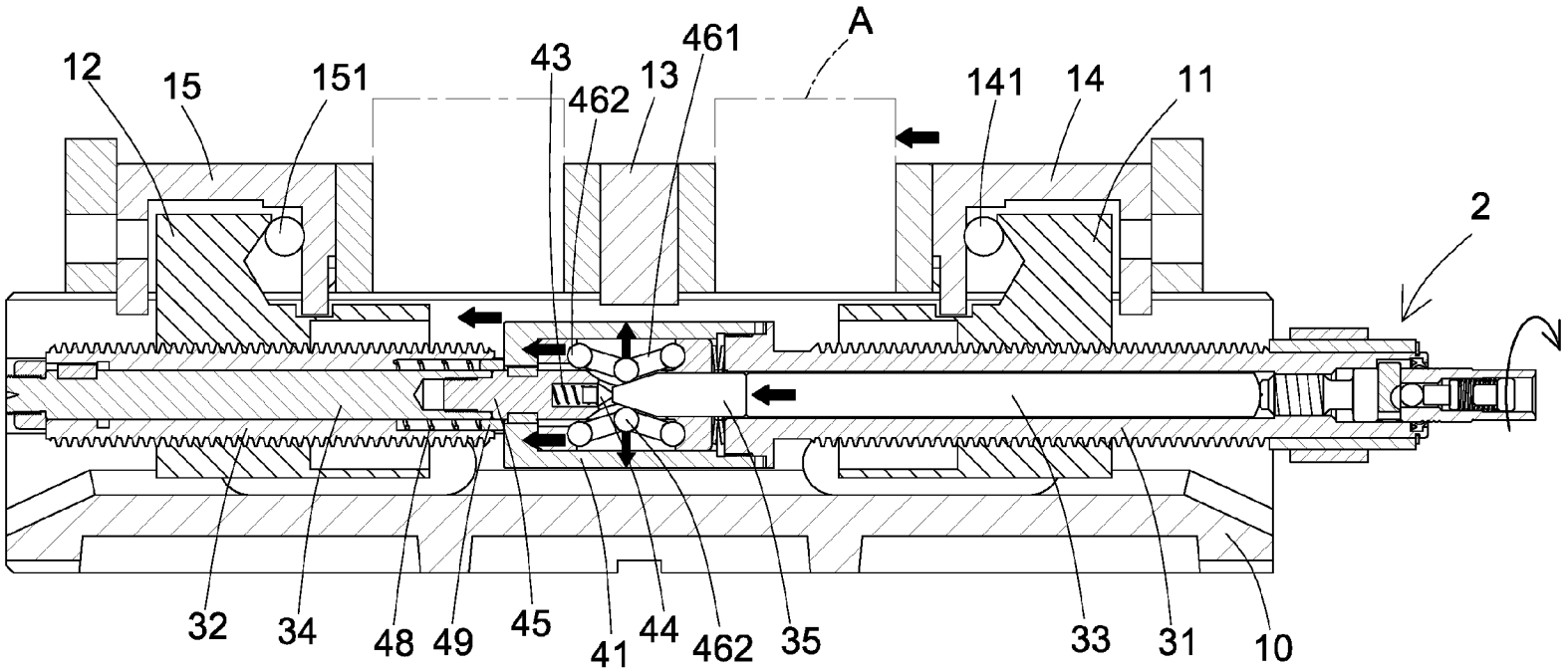
FIG. 6 is a view similar to FIG. 4 showing two same work pieces being clamped by the vise.

Fastening operation of the invention is discussed in detail below by referring to FIG. 6 specifically. First, two same work pieces A are placed in a gap between the fixed jaw 13 and the first movable jaw 14, and a gap between the fixed jaw 13 and the second movable jaw 15 respectively. Next, an individual may clockwise rotate the rotatable shaft 21 to advance the first threaded shaft 31. And in turn, the first sliding member 11 moves toward the fixed jaw 13 to push the first movable jaw 14 until the work piece A is fastened by and between the fixed jaw 13 and the first movable jaw 14. At the same time, the resilient ring 42 is compressed, the first movable rod 33 pushes the pushing rod 35 which in turn exerts a force on the rod elements 462 in the central portion of the toggle joints 461 to straighten the toggle joints 461, the pointed member 44 is pushed by the pushing rod 35 to compress the spring 43, the housing 41 is pushed toward the second movable jaw 15, the spring 48 is further compressed by the ring member 49, the second movable rod 34 is pushed leftward by the activation member 45, the second threaded shaft 32 rotates to move the second sliding member 12 toward the housing 41, and the second movable jaw 15 moves rightward until the other work piece A is fastened by and between the fixed jaw 13 and the second movable jaw 15.

A counterclockwise rotation of the rotatable shaft 21 unfastens the work pieces A.

Figure 7:
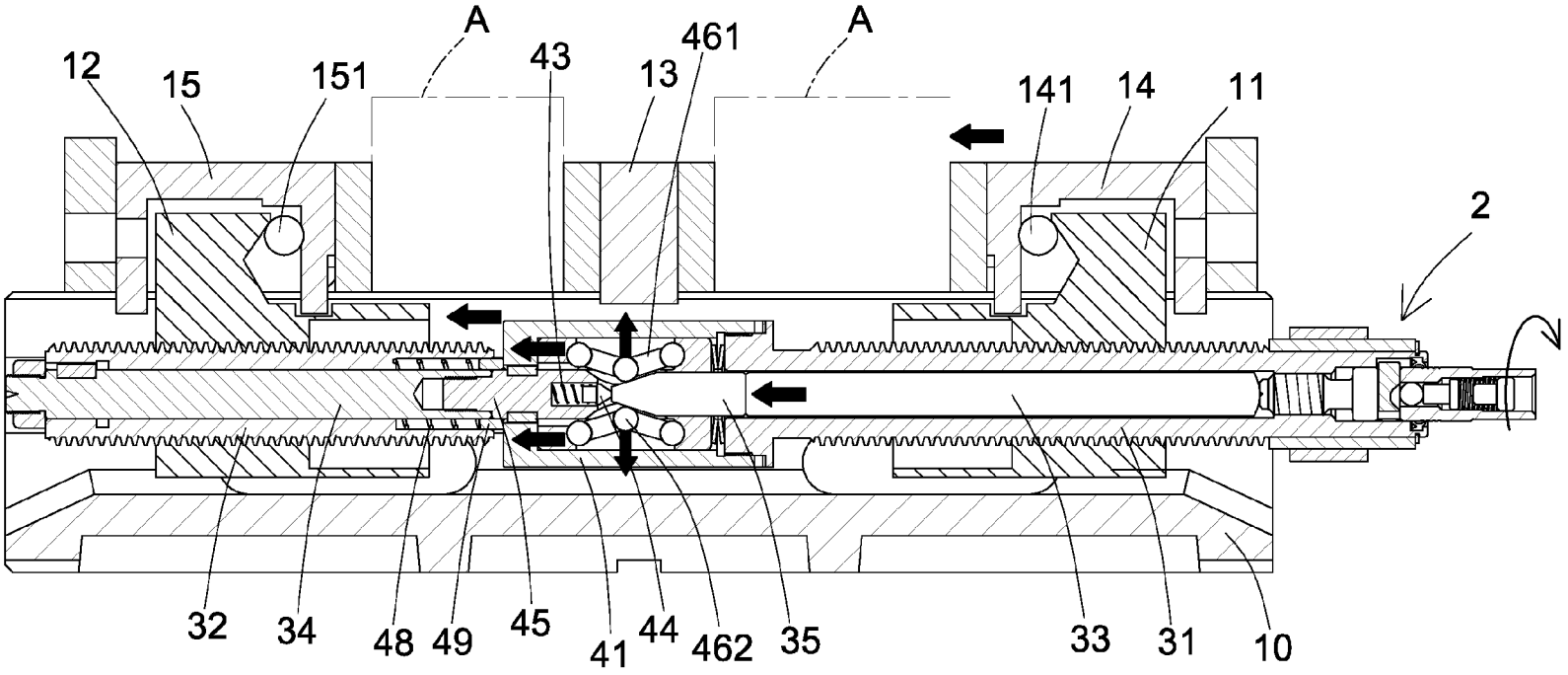
FIG. 7 a view similar to FIG. 4 showing two different work pieces being clamped by the vise.

Fastening operation of the invention is further discussed in detail below by referring to FIG. 7 specifically. In brief, two different work pieces A are placed in a gap between the fixed jaw 13 and the first movable jaw 14, and a gap between the fixed jaw 13 and the second movable jaw 15 respectively.

Figure 8:
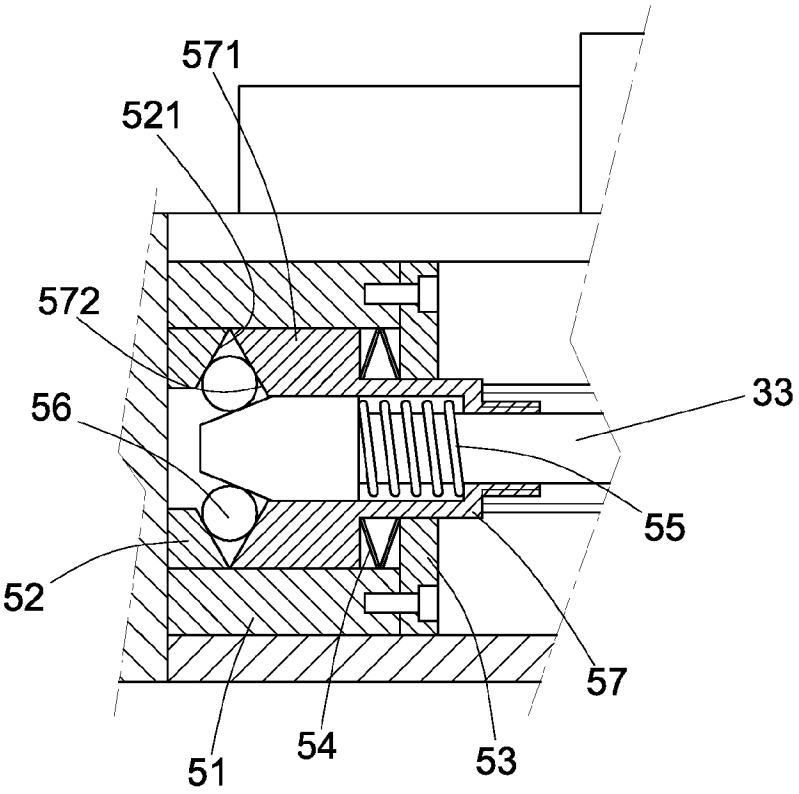
FIG. 8 is a sectional view showing a second embodiment of the force transmitting assembly.

Referring to FIG. 8, a second embodiment of a force transmitting assembly is shown. The characteristics of the second embodiment of the force transmitting assembly are substantially the same as that of the first embodiment except the following: The pushing rod is eliminated and its function is replaced by the first movable rod 33. The force transmitting assembly includes a housing 51, a positioning member 52 in the housing 51 and having an annular inclined surface 521, and a hollow member 57 partially in the housing 51 and having an enlargement 571 and an annular inclined surface 572. The first movable rod 33 has one end disposed through the hollow member 57. The force transmitting assembly further includes a block member 53 put on the hollow member 57 and secured to the housing 51, two steel balls 56 each rotatably positioned by the inclined surface 521, the inclined surface 572, and the first movable rod 33, and an annular resilient member 54 put on the hollow member 57 and disposed in a space defined by the hollow member 57, the housing 51, and the block member 53.

Figure 9:
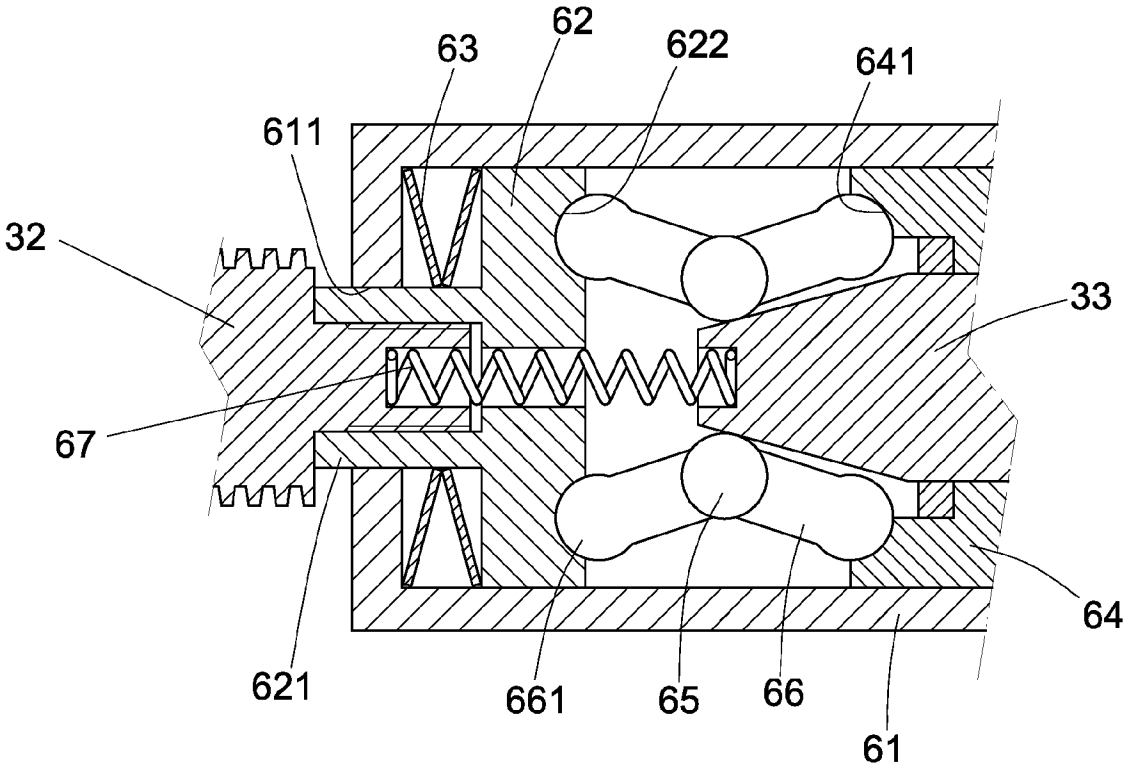
FIG. 9 is a sectional view showing a third embodiment of the force transmitting assembly.

Referring to FIG. 9, a third embodiment of a force transmitting assembly is shown. The characteristics of the third embodiment of the force transmitting assembly are substantially the same as that of the first embodiment except the following: The pushing rod is eliminated and its function is replaced by the first movable rod 33. The force transmitting assembly includes a housing 61, a positioning member 62 partially disposed in the housing 61 and having a hollow projection 621 passing through an opening 611 of the housing 61, and two opposite troughs 622, a torsion spring 67 having one end anchored in the first movable rod 33 and the other end passing through the positioning member 62 to anchor in the second threaded shaft 32, two toggle joints 65 each having two bars 66 each having two curved ends 661, and a block member 64 having two opposite grooves 641. The curved ends 661 are rotatably disposed in the troughs 622 and the grooves 641. Further, the toggle joints 65 are engaged with the movably rod 33. An annular resilient member 67 is disposed in a space defined by the housing 61, the positioning member 62, and the projection 621.

While the invention has been described in terms of preferred embodiments, those skilled in the art will recognize that the invention can be practiced with modifications within the spirit and scope of the appended claims.

What is claimed is:

1. A vise comprising:

a groove-shaped vise body including two grooves on inner surfaces of two sides respectively;

an internally threaded first sliding member including a concave surface, the first sliding members being configured to slide with respect to the vise body by sliding along the grooves;

an internally threaded second sliding member including a concave surface, the second sliding members being configured to slide with respect to the vise body by sliding along the grooves;

a fixed jaw secured to a top of an intermediate portion of the vise body;

a first movable jaw put on the first sliding member, the first movable jaw including a rod member disposed between the concave surface of the first sliding member and an inner surface of the first movable jaw;

a second movable jaw put on the second sliding member, the second movable jaw including a rod member disposed between the concave surface of the second sliding member and an inner surface of the second movable jaw;

a fastening device secured to the vise body and adjacent to the first movable jaw, the fastening device including a rotatable shaft;

an actuation assembly disposed in the vise body, the actuation assembly including a hollow first threaded shaft passing through and threadedly secured to the first sliding member, the first threaded shaft secured to the fastening device, a hollow second threaded shaft passing through the second sliding member and threadedly secured to the second sliding member, a first movable rod disposed in the first threaded shaft and secured to the rotatable shaft, a second movable rod disposed in the second threaded shaft, and a pushing rod engaging the first movable rod, the pushing rod having an inclined surface distal the first movable rod; and a force transmitting assembly disposed between the first threaded shaft and the second threaded shaft and under the fixed jaw, the force transmitting assembly including a hollow cylindrical housing secured to the first threaded shaft, a hollow activation member disposed in the housing and having two opposite troughs, a positioning member disposed in the housing and having two opposite troughs, two toggle joints each having a first end pivotaby disposed in one of the troughs of the positioning member, and a second end pivotably disposed in one of the troughs of the activation member, a spring-biased member disposed in the activation member and engaging the pushing rod, a biasing member put on the second movable rod and anchored between the second movable rod and the second threaded shaft, a ring member put on the activation member and biased between the biasing member and the activation member, and a resilient ring put on the pushing rod and biased between the activation member and the first threaded shaft;

whereby upon clockwise rotating the rotatable shaft, the first threaded shaft is rotated causing the first sliding member to move the first movable jaw toward the fixed jaw, compress the resilient ring, push the first movable rod to move the pushing rod which in turn straightens the toggle joints, push the housing toward the second movable jaw by compressing the biasing member, push the second movable rod to rotate the second threaded shaft which in turn moves the second sliding member toward the housing, and move the second movable jaw toward the fixed jaw.

* * * * *